United States Patent [19]

Poplin

[11] 4,187,650

[45] Feb. 12, 1980

[54] CONSTRUCTION UNIT

[76] Inventor: James E. Poplin, 3466 W. Magill, Fresno, Calif. 93705

[21] Appl. No.: 885,615

[22] Filed: Mar. 13, 1978

[51] Int. Cl.[2] ..... E04B 7/00

[52] U.S. Cl. ..... 52/57; 52/287

[58] Field of Search ..... 52/57, 278, 276, 279, 52/518, 528, 554, 560, 287

[56] References Cited

U.S. PATENT DOCUMENTS

| | | | |
|---|---|---|---|
| 720,892 | 2/1903 | Charlebois | 52/276 |
| 2,072,884 | 3/1937 | Hogenson | 52/278 |
| 2,134,034 | 10/1938 | Doe | 52/528 |
| 2,205,679 | 6/1940 | Ames | 52/554 |
| 2,305,008 | 12/1942 | Howard | 52/528 |
| 2,360,052 | 10/1944 | Fuller | 52/276 |
| 2,386,338 | 10/1945 | Norrid | 52/278 |
| 2,429,480 | 10/1947 | Miller | 52/276 |

FOREIGN PATENT DOCUMENTS

| | | | |
|---|---|---|---|
| 812747 | 5/1937 | France | 52/276 |
| 220644 | 8/1925 | United Kingdom | 52/278 |

*Primary Examiner*—James A. Leppink
*Assistant Examiner*—Henry E. Raduazo
*Attorney, Agent, or Firm*—Huebner & Worrel

[57] ABSTRACT

A construction unit having an envelope with a forward portion and bottom panels folded toward each other to define an interior for the envelope, and an insert disposed within the interior of the envelope adjacent to the forward portion of the envelope and captured by the bottom panels.

7 Claims, 10 Drawing Figures

FIG. 1
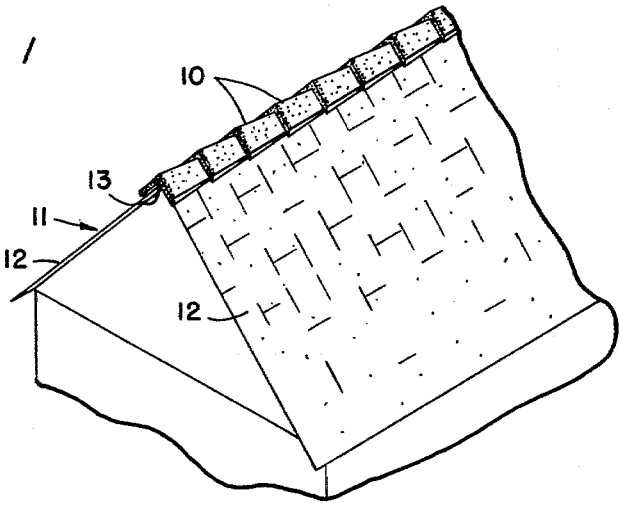
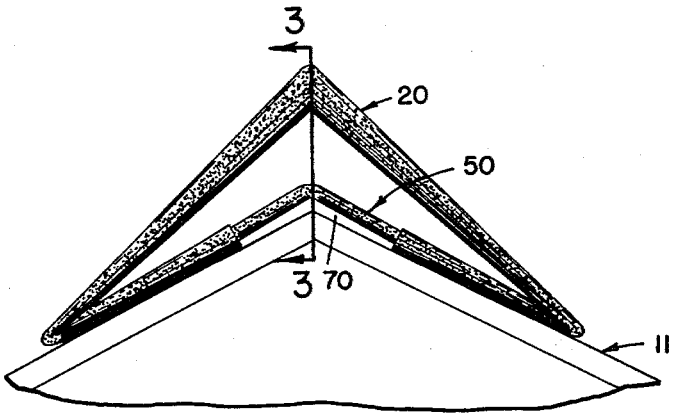
FIG. 2
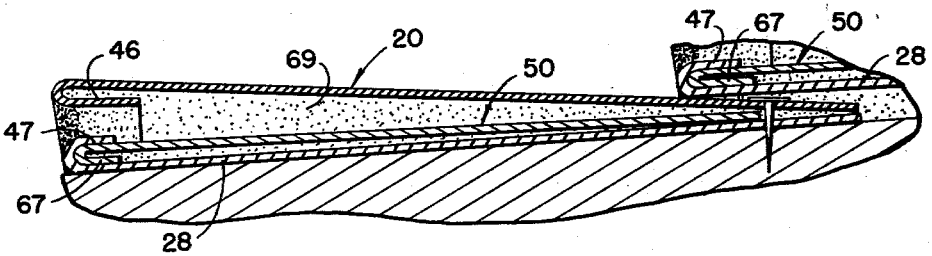
FIG. 3

CONSTRUCTION UNIT

BACKGROUND OF THE INVENTION

1. Field Of The Invention:

The present invention relates to a construction unit and more particularly to such a construction unit which has particular utility where installed as roofing or as a ridge unit for asphalt composition roofs imparting a pleasing exterior appearance to such roofs and possessing unique operative characteristics both in installation and during its operational life.

2. Description Of The Prior Art:

Asphalt composition roofing materials have a number of advantages over other forms of roof construction both in residential and commercial uses. Available asphalt roofing materials are readily installed, relatively inexpensive when compared with alternative forms of construction, and light in weight possessing the lowest load characteristics for comparable forms of roofing construction. Furthermore, asphalt roofing materials are quite durable and compare favorably in this respect with other materials.

Notwithstanding these advantages, asphalt roofing materials have not been as widely used as would otherwise be the case. This is due to their comparatively unattractive appearance when installed and to certain operative difficulties in installation and use. Once installed, such roofing construction tends to present an uninteresting, flat appearance as a result of a minimum of surface variation. Surface variation presents a pleasing appearance of tile and shake roofing and constitutes a primary reason of their wide usage. While some attempts have been made to alleviate these aesthetic deficiencies in asphalt composition roofing, such attempts have not been overly successful. Furthermore, it has been found difficult to achieve the double layer thickness of material required by building codes in combination with a sufficient surface variation and a pleasing appearance at an acceptable price.

The lamination of a plurality of sheets of asphalt composition material together to achieve the multiple thickness does not noticably improve the appearance since the sheets are themselves of minimal thickness. Furthermore, such laminated units do not have the tapered thickness which is characteristic of shake roofing and would be desirable in asphalt roofing. Other attempts to achieve an aesthetically pleasing appearance in asphalt roofing have required several of the units to be interlocked to achieve the number of layers required by building codes while incorporating, in one form or another a sufficient surface variation to achieve a pleasing appearance. Prior art efforts have been both expensive and difficult to install. Furthermore, the units are usually folded in packaging in a manner which frequently causes the units to crack along their uppermost surfaces thus substantially reducing their initial effectiveness and operational lives.

Therefore, it has long been known that it would be desirable to have a construction unit well suited to both residential and commercial roofing uses which, when installed, produces a roof having a pleasing exterior appearance with a significantly elevationally varied surface and which is readily installed, is of low cost and retains the multitude of operative advantages characteristic of conventional asphalt roofing materials.

SUMMARY OF THE INVENTION

It is therefore an object of the present invention to provide an improved construction unit which can be employed in a variety of construction uses including installation on side walls, roof surfaces and ridges.

Another object is to provide such a unit which is well suited to fabrication from asphalt composition roofing materials and has particular utility in use as a ridge unit.

Another object is to provide such a unit each of which is itself a significantly varied thickness to present an aesthetically pleasing elevationally varied surface when installed.

Another object is to provide such a unit which requires no specialized tools or procedures for installation.

Another object is to provide such a unit each of which possesses multiple layers of roofing material throughout its entire area so that a minimum overlap between the units is required to achieve optimum coverage thereby minimizing expense and installation time.

Another object is to provide such a unit which can automatically be adjusted to the dimensions of a ridge on which it is to be installed to achieve a precise facing engagement with the ridge and adjoining surfaces.

Another object is to provide such a unit which can be installed so as to permit a self-adjusting action accommodating expansion and contraction incident to temperature variations thereby reducing the incidence of cracking of the layers of material from which it is formed.

Another object is to provide such a unit which possesses an inherent ventilating capability.

Further objects and advantages are to provide improved elements and arrangements thereof in a device for the purposes described which is dependable, economical, durable and fully effective in accomplishing its intended purposes.

BRIEF DESCRIPTION OF THE DRAWINGS

FIG. 1 is a perspective view showing the construction units of the present invention in a typical operative environment.

FIG. 2 is a front elevation of one of the construction units.

FIG. 3 is a longitudinal vertical section taken on line 3—3 of FIG. 2.

DESCRIPTION OF THE PREFERRED EMBODIMENT

Referring more particularly to the drawings, the construction unit of the present invention is indicated by the numeral 10 in FIG. 1. As shown in FIG. 1, a plurality of the units are mounted on a pitched or hip roof 11 having convergently upwardly sloped surfaces 12 joining in ridges 13. It will be understood that the construction units can be used for roofing the sloped surfaces of roofs, on building walls and the like if desired. However, it is believed that the units have particular utility when installed on the ridges of roofs, as will hereinafter be described.

Figure 9:
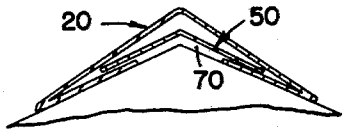
FIG. 9 is a transverse vertical section of the construction unit in an illustrative operative configuration.
Figure 8:
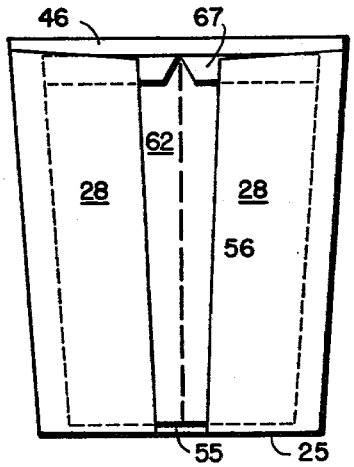
FIG. 8 is a bottom plan view of the assembled construction unit.
Figure 10:
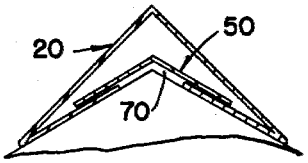
FIG. 10 is a transverse vertical section of the construction unit in a second illustrative operative configuration.

Each construction unit 10 has an outer jacket or envelope 20 which can be fabricated from any suitable sheet material. Preferably the envelope is constructed of a sheet of asphalt composition roofing material 21. A variety of asphalt composition roofing materials are commercially available which are excellently suited for the purpose including the material sold under the trademark "Celotex". The sheet 21 has a forward portion 22 bounded by a forward edge 23. Similarly, the sheet has a rearward portion 24 bounded by a rearward edge 25 which is preferably, although not necessarily, substantially parallel to the forward edge 23. The sheet has a longitudinal axis 26 extending in right angular relation from the forward edge to the rearward edge and disposed substantially centrally thereof. As will hereinafter be described, the sheet can be bent along the longitudinal axis to form a pair of angularly related planes, as best shown in FIGS. 9 and 10. For purposes of illustrative convenience, the sheet can be viewed as having a pair of rearwardly convergent reference lines 27 equally spaced from the longitudinal axis on opposite sides thereof and convergent therealong in the direction of the rearward edge 25 of the sheet. The reference lines define outer opposite flap portions 28 which are individually bounded laterally by lateral edges 29 which are convergent in the direction of the rearward edge. Preferably, although not necessarily, each reference line is spaced from the longitudinal axis at the forward portion of the sheet a slightly greater distance than the distance from that reference line to the adjacent lateral edge. Preferably each reference line is spaced from the longitudinal axis at the rearward portion of the sheet slightly more than the distance from the reference line to the adjacent lateral edge.

For purposes of illustrative convenience, it will be understood that the area between the forward and rearward edges 23 and 25 and the reference lines 27 constitutes a central section 30 for the sheet. Similarly, the sheet, when in a folded condition as will hereinafter be described, has an interior surface 31 and an opposite outer or exterior surface 32. The exterior surface 32, of course, has any surface treatment which the commercially available sheet material 21 possesses, such as a granular coating and any particular coloration desired.

Figure 4:
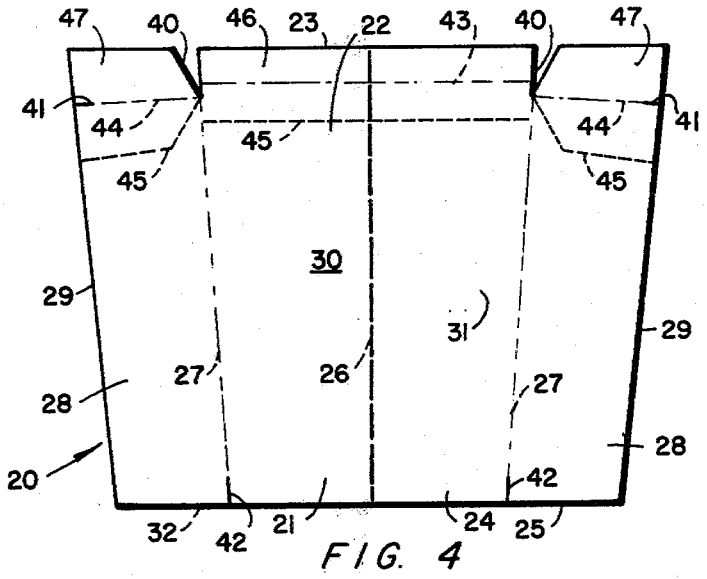
FIG. 4 is a plan view of the interior surface of a sheet of material employed in fabricating the envelope of the construction unit.
Figure 5:
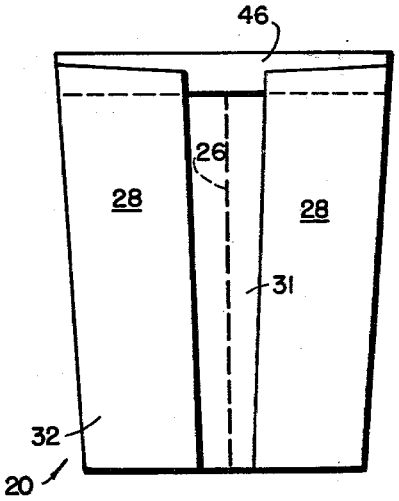
FIG. 5 is a bottom plan view of the sheet of FIG. 4 after having been folded to form the envelope.
Figure 6:
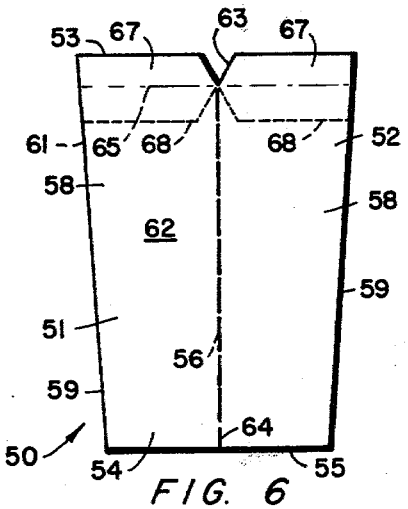
FIG. 6 is a plan view of the lower surface of a sheet of material employed in fabricating the insert of the construction unit.
Figure 7:
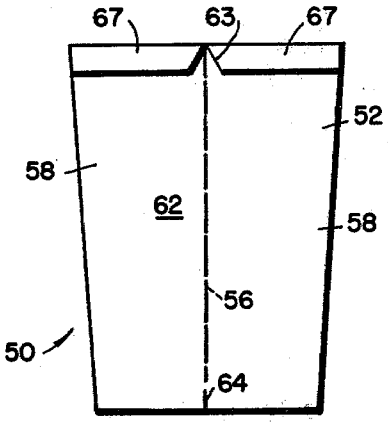
FIG. 7 is a bottom plan view of the sheet of FIG. 6 after having been folded to form the insert.

A pair of notches 40 individually extend inwardly from the forward edge 23 of the sheet 21 a predetermined distance along their respective reference lines 27, as shown in FIG. 4. A pair of forward slices 41 individually extend inwardly from their respective lateral edges 29 in individual spaced relation to the forward edge 23 of the sheet and preferably approximately aligned with the inwardmost extension of the adjacent notch 40. A pair of rearward slices 42 extend inwardly from the rearward edge 25 of the sheet individually along the reference lines 27. The slices 41 and 42 are preferably of very short length such as approximately ½ inch [1.27 cm].

For illustrative convenience, a central fold line is indicated at 43 at the forward portion 22 of the central section 30 extending substantially parallel to the forward edge 23 and at right angles to the longitudinal axis 26. The central fold line is preferably spaced from the forward edge of the sheet approximately half the distance of the length of the notches 40. Lateral fold lines 44 individually interconnect each forward slice 41 and the inward end of its respective adjacent notch 40. Reference lines 45 indicate the positions of the portions of the forward edge 23 when folded about their respective fold lines 43 and 44, as will subsequently be described. The forward portion 22 of the sheet 21 between the notches 40 constitutes a central flap 46. The forward portions of the sheet between each notch and its respective adjacent lateral edge 29 constitutes a lateral flap 47.

Each construction unit 10 has a first panel or insert 50 constructed of a sheet of asphalt roofing material 51. As with the sheet 21 of the envelope 20, the sheet 51 can be fabricated from any suitable material such as commercially available asphalt roofing material. The sheet has a forward portion 52 bounded by a forward edge 53. The sheet has a rearward portion 54 bounded by a rearward edge 55 which is preferably substantially parallel to the forward edge 53. The sheet has a longitudinal axis 56 interconnecting at substantially right angles the forward and rearward edges 53 and 55 respectively. The longitudinal axis designates lateral portions 58 on the opposite sides thereof which are bounded by convergent lateral edges 59. The lateral edges converge in the direction of the rearward edge 55 of the sheet.

For illustrative convenience, the sheet 51 has an upper surface 61 and an opposite lower surface 62. A central notch 63 extends inwardly from the forward edge 53 along the longitudinal axis 56 a predetermined, relatively short distance. A rearward slice 64 is formed in the sheet extending inwardly from the rearward edge 55 along the longitudinal axis 56. A forward fold line is indicated at 65 extending at right angles to the longitudinal axis substantially parallel to the forward edge 53 of the sheet and coincident with the innermost portion of the notch 63. The notch and forward fold line 65 define a pair of flaps 67 individually disposed on opposite sides of the notch. Reference line 68 indicates the position of the forward edges 53 of the flaps 67 when folded about the fold line 65. The flaps 67 are thus folded along forward fold lines 65 into facing engagement with the lower surface 62 of the sheet 51.

The central and lateral flaps 46 and 47 respectively of the sheet 21 of the envelope 20 are folded along their respective central and lateral fold lines 43 and 44 to the positions indicated by reference lines 45. The flaps are folded into facing engagement with the interior surface 31 of the sheet 21. The opposite flap portions 28 of the envelope are then folded along their respective reference lines 27 toward the longitudinal axis 26 until the lateral flaps 47 are disposed in juxtaposition to and slightly inward from the central flap 46. The flap portions 28 and central section 30 thus define an interior 69 for the envelope therebetween. The insert 50 is then inserted within the interior envelope so that the flaps 67 of the insert are disposed in mating engagement with and within the lateral flaps 47 of the envelope, as best shown in FIG. 3. The insert is thus positioned with its upper surface 61 juxtaposed the interior surface 31 of the central section 30 of the envelope 20. The flaps 67 are disposed beneath and slightly rearwardly from the central flap 46 of the envelope. As can be seen in FIG. 2, the lateral edges of the sheet 21 of the envelope are, in this configuration, disposed in opposed spaced relation to define an air space or passage 70 therebetween leading under the insert. The flap portions are slidable toward and from each other on the lateral portions 58 of the insert.

OPERATION

The operation of the described embodiment of the subject invention is believed to be clearly apparent and is briefly summarized at this point. The construction units 10 are installed along the ridge 13 of the roof so as to form the configuration shown in FIG. 1. Such installation requires no special tools, instructions, or unusual care. Furthermore, the construction units can be attached to the roof by any suitable manner as appears most appropriate for the use intended. In most situations, staples or nails are driven through the envelope adjacent to the rearward edge 25 thereof and into the roof to secure the unit on the roof. Thus, the forward portion 22 of the envelope need not be secured and can be left in overlapping engagement to the unit just below it. Where desired, this overlap can extend over the staple or nail of the next adjoining unit so that no staples or nails are left exposed. However, such overlap is not necessary for complete coverage due to the multiple layers of roofing material in each unit. The extent of the overlap from unit to unit is not critical, but is ordinarily approximately 1½ inches [3.81 cm] to 2 inches [5.08 cm]. This produces multiple layers of roofing material using a minimum of overlap and thus conserving on the overall expense of the roofing operation.

Referring more particularly to FIGS. 9 and 10, it will be seen that the construction unit 10 of the present invention is uniquely adapted for precisely fitting any configuration of roof line while permitting the surface variation to be precisely controlled. The unit can be bent or folded along the longitudinal axis 26 of the envelope 20 and along the longitudinal axis 56 of the insert 50 to fit the specific ridge configuration encountered. This is true even where the angle of the ridge varies on the roof. Since the flap portions 28 of the envelope are slidably adjustable along the lateral portions 58 of the insert, the insert can be fitted to the ridge configuration and the exterior surface 32 of the central section 30 adjusted to the specific height relationship desired for the optimum aesthetic effect. Thus, the distance between the longitudinal axis 26 of the envelope and the longitudinal axis 56 of the insert can be varied by sliding the flap portions 28 to position their lateral edges 29 relatively closer or relatively farther apart to elevate or alternatively lower the longitudinal axis of the envelope. Although it is not necessary, particularly where a relatively greater distance between the longitudinal axes 26 and 56 is desired, it may be desired to drive nails or staples through the envelope adjacent to the forward edge 23 to retain the configuration selected. Thus the construction unit 10 of the present invention is adjustable to fit any specific configuration desired from a sharp ridge configuration to a flat roof or wall configuration simply by individual adjustment by the worker installing the units on the roof.

Where, as is normally the case, each unit 10 is secured only adjacent to the rearward edge 25 of the envelope 20, the forward portion 22 of the envelope is free to adjust laterally to accommodate expansion and contraction of the sheet material 21 and 51 due to temperature variation as well as due to weight being exerted thereon such as by someone walking on the roof. The air passage 70 permits each unit to allow ventilation from beneath the units and from out of the attic of the house. Each construction unit, without taking into consideration the overlap of the installed construction units, has a minimum coverage of two layers. For most of the surface area covered by an individual unit, the coverage is actually three layers thick with some areas, such as the forward portion having effectively six layers of sheet material. In the areas of overlap the coverage is, of course, greater. Furthermore, the exterior surface 32 of the construction unit has no slices or other concessions to assembly which is conventional devices reduces their operational lives. Moreover, it has been found that the cost of the construction units is less than most commercially available roofing materials.

Therefore, the construction unit of the present invention provides a superior and economically acceptable form of roofing construction employing a minimum of two layers of roofing material in combination with an optimum aesthetic appeal and unique operational benefits during installation and use while retaining the multitude of other operative advantages inherent in the use of other operative advantages inherent in the use of asphalt roofing materials.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A construction unit comprising an envelope having a forward portion, bottom panels folded toward each other to define an interior for the envelope and an upper panel folded rearwardly at said forward portion into said interior to impart increased rigidity to the upper panel at said forward portion and wherein said upper panel is folded along a longitudinal axis extending at approximately right angles to the forward portion of the envelope; and an insert disposed within the interior of the envelope adjacent to said forward portion and captured by the bottom panels, wherein said bottom panels at the forward portion of the envelope are folded rearwardly toward the interior of the envelope and about the insert to capture the insert within the interior at the forward portion of the envelope and wherein said bottom panels of the envelope are slidable to and from each other along the insert whereby the distance between said longitudinal axis of the upper panel and the insert can be increased and alternatively decreased by sliding the bottom panels toward and alternatively from each other.

2. The unit of claim 1 wherein the insert is creased along a longitudinal axis extending from the forward portion of the envelope to permit said insert to be folded into facing engagement with an angular surface while retaining said slidable relationship of the bottom panels.

3. A ridge unit for roofs and the like comprising a first panel having predetermined forward, rearward and lateral portions and being folded along said forward portion; and an outer jacket composed of a single sheet of construction material having predetermined forward and rearward portions with opposite flap portions folded toward each other about said lateral portions of the first panel to capture the first panel within the outer jacket and said forward portion of the outer jacket being folded inwardly and said flap portions being folded inwardly about said folded forward portion of the first panel to capture the said first panel within the outer jacket.

4. The unit of claim 3 wherein the flap portions are slidable to and from each other along the lateral portions of the first panel to permit self-adjustment of said ridge unit to the roof.

5. The unit of claim 3 wherein said forward portion of the outer jacket is darkened visibly to enhance the apparent thickness thereof.

6. The unit of claim 3 wherein said opposite flap portions of the outer jacket are spaced from each other to define an air passage therebetween extending from the forward portion of the outer jacket beneath the first panel toward the rearward portion of the outer jacket.

7. A construction unit comprising a first panel having lateral portions; and an outer jacket overlaying said first panel and having a central section with a predetermined axis and flap portions folded, along courses laterally disposed from and on opposite sides of said predetermined axis, toward each other about the lateral portions of the first panel and said flap portions being slidable toward and from each other along the first panel to adjust the distance between the first panel and the central section of the outer jacket and said flap portions of the outer jacket having individual forward portions which are folded inwardly about the first panel to capture the first panel within the outer jacket.

* * * * *